US008569658B2

(12) United States Patent
Allgaier et al.

(10) Patent No.: US 8,569,658 B2
(45) Date of Patent: Oct. 29, 2013

(54) COMPOSITE CONDUCTOR, IN PARTICULAR FOR GLOW PLUGS FOR DIESEL ENGINES

(75) Inventors: Martin Allgaier, Ludwigsburg (DE); Hans Peter Kasimirski, Ludwigsburg (DE); Rainer Hain, Steinheim (DE); Bernhard Graf, Freiberg (DE); Oliver Göb, Marbach (DE); Lutz Frassek, Rödental (DE); Johannes Hasenkamp, Ludwigsburg (DE); Jochen Hammer, Stuttgart (DE); Henning Von Watzdorf, Beilstein (DE); Hans Houben, Würselen (DE)

(73) Assignee: BERU Aktiengesellschaft, Ludwigsburg (DE)

( * ) Notice: Subject to any disclaimer, the term of this patent is extended or adjusted under 35 U.S.C. 154(b) by 1111 days.

(21) Appl. No.: 11/992,395

(22) PCT Filed: Sep. 21, 2006

(86) PCT No.: PCT/EP2006/009169

§ 371 (c)(1),
(2), (4) Date: Jul. 15, 2009

(87) PCT Pub. No.: WO2007/033824

PCT Pub. Date: Mar. 29, 2007

(65) Prior Publication Data

US 2010/0000982 A1 Jan. 7, 2010

(30) Foreign Application Priority Data

Sep. 22, 2005 (DE) ..... 10 2005 045 256
Apr. 6, 2006 (DE) ..... 10 2006 016 566

(51) Int. Cl.

| | |
|---|---|
| ***F23Q 7/22*** | (2006.01) |
| ***F23Q 7/00*** | (2006.01) |
| ***F02B 1/12*** | (2006.01) |
| ***F02B 3/06*** | (2006.01) |
| ***F02B 9/00*** | (2006.01) |
| ***F02B 19/00*** | (2006.01) |
| ***F02B 23/00*** | (2006.01) |
| ***F02B 13/00*** | (2006.01) |

(52) U.S. Cl.
USPC ..... 219/270; 219/260; 219/267; 219/268; 123/143 A; 123/143 B; 123/143 C

(58) Field of Classification Search
USPC ..... 219/270, 260–269; 123/143 R–143 C
See application file for complete search history.

(56) References Cited

U.S. PATENT DOCUMENTS

| | | | |
|---|---|---|---|
| 4,742,209 | A | 5/1988 | Minegishi et al. |
| 5,059,768 | A | 10/1991 | Hatanaka et al. |

(Continued)

FOREIGN PATENT DOCUMENTS

| | | | |
|---|---|---|---|
| DE | 102 49 408 | A1 | 6/2003 |
| DE | 298 24 933 | U1 | 8/2003 |

(Continued)

*Primary Examiner* — Quang Van
*Assistant Examiner* — Michael Hoang

(57) ABSTRACT

Composite conductor comprising a metallic conductor and a ceramic conductor or non-conductor, at least one of them being elongate, the two being connected with each other in an electrically conductive manner. The ceramic conductor or non-conductor and the metallic conductor are hard-soldered to each other by a contact surface extending obliquely to the longitudinal direction of the at least one elongate conductor, and has one of the conductors tapers at its end and the other conductor has a matching tapering recess. The tapering end of the conductor is fitted into the tapering recess.

19 Claims, 9 Drawing Sheets

(56) References Cited

U.S. PATENT DOCUMENTS

| | | | | | |
|---|---|---|---|---|---|
| 5,075,536 | A | * | 12/1991 | Towe et al. | 219/270 |
| 5,304,778 | A | * | 4/1994 | Dasgupta et al. | 219/270 |
| 5,589,091 | A | * | 12/1996 | Muller | 219/270 |
| 5,880,432 | A | | 3/1999 | Radmacher | |
| 6,084,212 | A | | 7/2000 | Leigh | |
| 6,184,497 | B1 | | 2/2001 | Leigh | |
| 6,335,516 | B1 | | 1/2002 | Mueller et al. | |
| 6,610,964 | B2 | | 8/2003 | Radmacher | |
| 6,699,089 | B2 | | 3/2004 | Ninomiya | |
| 6,727,473 | B2 | * | 4/2004 | Taniguchi et al. | 219/270 |
| 6,737,612 | B2 | * | 5/2004 | Taniguchi et al. | 219/270 |
| 6,770,850 | B2 | * | 8/2004 | Taniguchi et al. | 219/270 |
| 6,884,967 | B1 | * | 4/2005 | Leigh | 219/270 |
| 7,020,952 | B2 | | 4/2006 | Watanabe et al. | |
| 7,160,584 | B2 | | 1/2007 | Goeb et al. | |
| 8,153,936 | B2 | * | 4/2012 | Kernwein et al. | 219/260 |
| 2003/0042242 | A1 | * | 3/2003 | Taniguchi et al. | 219/270 |
| 2003/0042243 | A1 | * | 3/2003 | Taniguchi et al. | 219/270 |
| 2010/0000982 | A1 | * | 1/2010 | Allgaier et al. | 219/270 |

FOREIGN PATENT DOCUMENTS

| | | | | |
|---|---|---|---|---|
| DE | 102 28 077 | A1 | | 1/2004 |
| EP | 0 350 735 | A | | 1/1990 |
| EP | 0 909 923 | B1 | | 7/2000 |
| EP | 1 457 736 | A1 | | 9/2004 |
| GB | 1 402 935 | A | | 8/1975 |
| GB | 1 447 964 | A | | 9/1976 |
| GB | 2 051 225 | A | | 1/1981 |
| JP | 09303773 | A | * | 11/1997 |
| JP | 10185192 | A | * | 7/1998 |

* cited by examiner

Fig.1
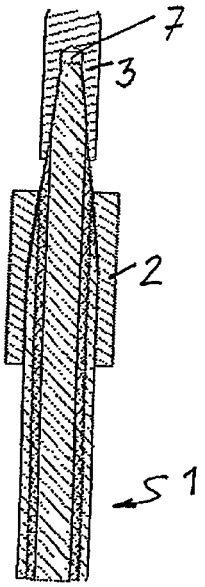
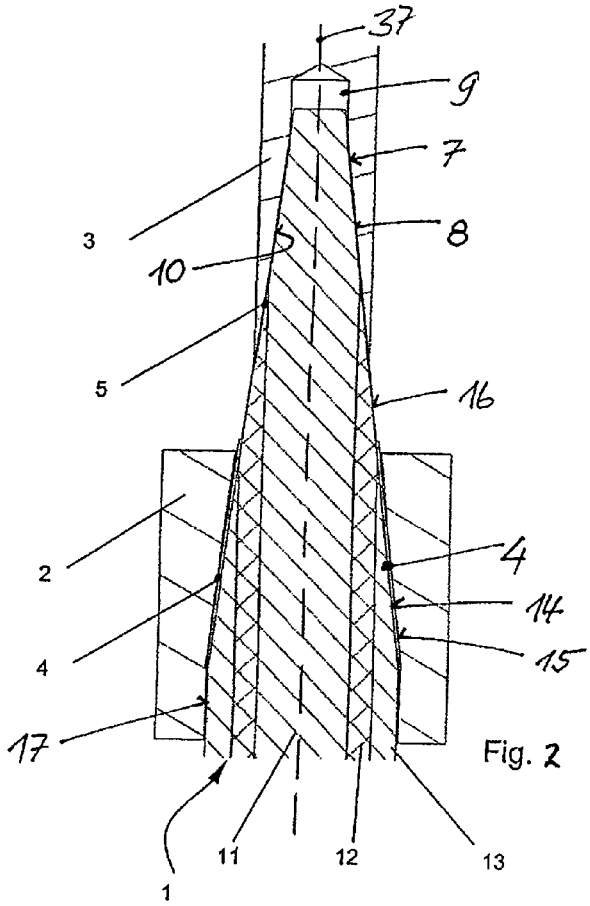
Fig. 2
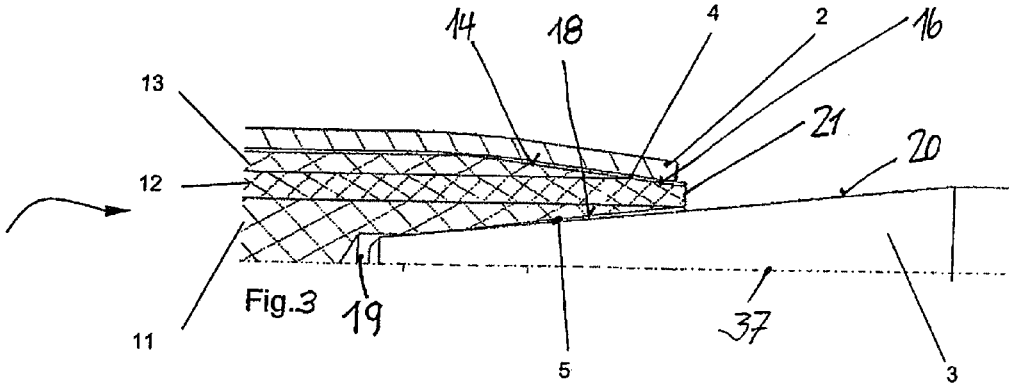
Fig.3

COMPOSITE CONDUCTOR, IN PARTICULAR FOR GLOW PLUGS FOR DIESEL ENGINES

The present invention relates to a composite electric conductor, in particular for a glow plug for diesel engines. A composite electric conductor for a glow plug for diesel engines, having the features of the preamble of Claim 1, has been known from DE 103 53 972 A1. It comprises an elongate ceramic inner conductor, an elongate ceramic outer conductor surrounding the ceramic inner conductor and an insulator, likewise of a ceramic kind, arranged between the ceramic inner conductor and the ceramic outer conductor. The inner conductor, the outer conductor and the insulator are arranged coaxially one relative to the other. The composite conductor is produced by a powder metallurgy process by coextrusion and subsequent sintering. It is then further processed to form ceramic glow pencils for use in glow plugs for diesel engines. For this purpose, the conductor is cut to sections of a predefined length, one end of which, i.e. the one end that later will project into the combustion chamber of the diesel engine, is provided with a heating layer which constitutes an electric heating resistor that connects the ceramic inner conductor and the ceramic outer conductor at their forward ends.

During production of a glow plug, the ceramic inner conductor and the ceramic outer conductor must be connected to metallic supply lines in an electrically conductive way. The way in which this is to be effected is not disclosed by DE 103 53 972 A1.

DE 40 28 859 A1 discloses a glow plug with a ceramic heating device. However, the ceramic heating device does not comprise a coaxial ceramic conductor, but rather a U-shaped ceramic conductor both legs of which are run, in insulated manner, into the metallic housing of the glow plug where their ends are fitted in, and are hard-soldered to metallic caps. The caps in their turn are electrically connected to two supply lines, one represented by the housing of the glow plug and the other one being coaxially arranged in the housing and being guided out of the housing, in an insulated manner, at the rear end of the housing.

The manner of connecting ceramic conductors to metallic supply lines, known from DE 40 28 859 A1, is not applicable to a ceramic conductor of coaxial design of the kind known from DE 103 53 972 A1.

SUMMARY OF THE INVENTION

Now, it is an object of the present invention to show a way how a ceramic electric conductor, in particular a composite electric conductor comprising an elongate ceramic inner conductor, an elongate ceramic outer conductor and an insulator arranged between the two, can be connected to electric supply lines at low cost and reliably, in a way so that they will be suitable for use at temperatures above 200° Celsius, preferably also in glow plugs for diesel engines.

That object is achieved by a composite electric conductor having the features defined in Claim 1. Advantageous further developments of the invention are the subject-matter of the sub-claims.

According to the invention, a composite electric conductor comprising a ceramic conductor or non-conductor and a metallic conductor, at least one of them being elongate, is formed by a method where the ceramic conductor and the metallic conductor are hard-soldered to each other via a contact surface extending obliquely to the longitudinal direction of the at least one elongate conductor, whereby they are connected to each other in an electrically conductive way.

This provides significant advantages:

By making the electric contact between the ceramic conductor or non-conductor and the metallic conductor via a contact surface extending obliquely to the longitudinal direction, a relatively large contact area is achieved, even in the case of small conductor cross-sections, which allows low contact resistance and a sufficiently firm durable soldered connection to be achieved.

By having the contact surfaces extending obliquely, instead of at a right angle, to the longitudinal axis of the at least one elongate conductor it is possible not only to produce the heat required for the soldering process by current flowing through the conductors to be connected, but also to supply heat from the outside by a non-contact method, for example by inductive heating of the conductors. The composite electric conductor on which a hard-soldering operation is to be carried out is arranged for this purpose in an electric induction loop to which an electric current is supplied for heating up by induction the metallic conductor in the first line. Heating up the contact surfaces by electric induction can be carried out very efficiently and permits short cycle times to be achieved, which in any case may be below 30 s for each soldering operation and which even may be reduced to a few seconds per soldering operation.

In spite of relatively large soldering surfaces, the invention permits a compact design of the composite electric conductor to be achieved.

Special advantages are achieved by a composite electric conductor where one conductor tapers at its one end and the other conductor is provided with a matching tapering recess in which the tapering end of the one conductor is fitted. In that case a self-centering effect is achieved during production of the composite conductor, which helps achieve small production tolerances, further the surfaces can be pressed against each other and any undesirable access of air to the solder during the soldering operation is impeded.

Particular advantages are achieved by a wedge-shaped or conical taper on the one conductor and a matching wedge-shaped or conical recess in the other conductor. The wedge shape may be formed simply by two oppositely inclined surfaces, but may also be formed by more than two surfaces extending obliquely to the longitudinal direction and forming the lateral surfaces of a pyramid with three or more than three sides.

The invention is also suited for composite conductors where at least one of the conductors is enclosed by an electric insulator, especially a ceramic insulator, which may be covered by the hard solder over part of its length without its insulating efficiency being impaired.

The invention is of particular advantage for a composite conductor where an elongate ceramic inner conductor is connected to an elongate metallic inner conductor in an electrically conductive way and where an elongate ceramic outer conductor, enclosing the ceramic inner conductor, is connected to an elongate metallic outer conductor in an electrically conductive way, with an insulator arranged between the ceramic inner conductor and the ceramic outer conductor. At least one of the two ceramic conductors, and the metallic conductor making contact with it, are fitted one in the other and establish electric contact one with the other via a lateral surface extending obliquely to their longitudinal direction and via an oppositely arranged, correspondingly oblique inner surface which are hard-soldered to each other.

This provides significant advantages:

By establishing the electric contact between the at least one ceramic conductor and the metallic conductor via a surface extending obliquely to its longitudinal direction, especially via a lateral surface and an oppositely arranged correspondingly inclined inner surface, a relatively large contact area is achieved, even in the case of small conductor cross-sections, which allows low contact resistance and a sufficiently firm durable soldered connection to be achieved.

By fitting the at least one ceramic conductor, and the metallic conductor to be connected with it, one in the other and by connecting the two via contact surfaces extending obliquely to their longitudinal direction, a self-centering effect is achieved during production of the composite conductor, which helps achieve small production tolerances.

By fitting the at least one ceramic conductor, and the metallic conductor to be connected with it, one in the other, along surfaces extending obliquely to their longitudinal direction, it is easily possible to push the two conductors to be connected during the soldering operation one into the other, whereby the solder is pressed onto the contact surfaces. This provides the further advantage that the solder will reliably wet the two contact surfaces while the thickness of the solder layer can be limited to a minimum. The coefficient of thermal expansion of the solder, which may be different from the coefficient of thermal expansion of the ceramic conductor and of the metallic conductor, will have no detrimental effect on the durability of the soldered connection; instead, the solder between the contact surfaces will act as a thin, ductile equalizing layer.

By fitting the at least one ceramic conductor, and the metallic conductor to be connected to it, one in the other and connecting the two via an inclined surface, especially via an oblique lateral surface and an oppositely arranged correspondingly oblique inner surface, any undesirable access of air to the solder during the soldering operation is impeded so that the solder will react as desired with the two contact surfaces to be connected, but not with air.

In spite of its relatively large soldering surfaces, the invention allows a compact design of the composite electric conductor, especially when not only one but both ceramic conductors, and their corresponding metallic conductors, are fitted one in the other and make contact via lateral surfaces extending obliquely to their longitudinal direction and oppositely arranged, correspondingly oblique inner surfaces that are hard-soldered to each other.

Preferably, the metallic outer conductor encloses the metallic inner conductor from which it is electrically insulated. However, it is not strictly necessary that the metallic inner conductor be enclosed by the metallic outer conductor. Rather, the term "inner conductor" used for the metallic inner conductor only means to say that it forms a continuation of the ceramic inner conductor. If the metallic outer conductor does not enclose the metallic inner conductor, then it will enclose the ceramic outer conductor instead, at least over part of its length, and preferably only over part of its length.

The inner conductor and the outer conductor need not have a circular or annular cross-section. Instead, their cross-sections may also be oval, elliptical, rectangular or polygonal. Circular or annular cross-sections are, however, preferred because those cross-sections are especially favorable with respect to low-cost production. Conveniently, the inner conductors and the outer conductors are arranged coaxially to each other in that case.

Preferably, the contact-making lateral surfaces are frustum-shaped surfaces. This provides the easiest way of centering the fitted connections and of distributing the solder in the annular gap between the contact surfaces in a uniform and thin layer.

Hard solders suited for connecting metallic and ceramic components with each other are known in the art, especially hard solders based on silver. When working with standard silver-based hard solders, the ceramic contact surface must first be metallized. According to the invention, preferably an active solder is used. This provides the advantage that the step of metallizing the ceramic contact surface can be avoided. Active solders do not flow on ceramics. Consequently, the active solder is applied in cold condition between the surfaces to be soldered to each other. Those surfaces are then pressed together, and the connection area is heated up to the soldering temperature. Once the solder melts, it is distributed uniformly by pressing the contact surfaces together. In the wetting state active solders react with the ceramic surface, but also with oxygen and with nitrogen. However, due to the particular design of the soldering surfaces provided by the invention, air hardly has the chance to reach the hot solder so that, contrary to the conditions otherwise found when soldering with active solders, the soldering operation need not be carried out under a high-grade inert gas atmosphere or under high-vacuum conditions.

An active solder well suited is B—Ag72.5CuInTi 730/760 according to ISO 3677 which has the following composition: 72.5% by weight of silver, 19.5% by weight of copper, 5% by weight of indium, 3% by weight of titanium. That solder has a melting range of 730° Celsius to 750° Celsius, and a working temperature (soldering temperature) of approximately 850° Celsius to 950° Celsius.

One way of applying the solder to one of the contact surfaces to be connected to each other would be to produce frustum shaped form pieces of active solder. Producing such form pieces would, however, be expensive. The use of a foil made from the active solder, which can be processed off the roll, is therefore preferred. A separate section of the active solder foil is wound up in cone shape and is placed in the recess of one of the conductors, which is delimited by an inner surface to be soldered, preferably in frustum shape. Once placed in that recess, the active solder foil, provided it is sufficiently elastic, will uncoil automatically until it comes to rest flat against the inner surface to be soldered. In case the active solder foil should have too little or no elasticity, it will be uncoiled and clamped between the two contact surfaces to be soldered to each other when the oblique lateral surface of the matching other frustum-shaped conductor is fitted in the recess in which the active solder foil has been placed. This makes the operation very effective.

The angle formed between the contact surfaces to be soldered to each other and the longitudinal axis of the conductors is, preferably, smaller than 45°. Contact surfaces in the form of a very slim wedge or frustum surfaces, forming an angle between the contact surface and the longitudinal axis of the conductors smaller than 20°, preferably as small as 5° to 15°, are especially preferred. This seems to be optimal in regard of the desired large contact surfaces, combined with small conductor cross-sections, with respect to an advantageous self-centering effect and the possibility to exert pressure on the solder between the contact surfaces for achieving uniform distribution of the solder. In principle, it does not matter whether the surfaces or lateral surfaces to be soldered are provided on the ceramic conductors or on the metallic conductors. Preferably, at least one of the surfaces or lateral surfaces to be soldered should be provided on one of the ceramic conductors, in the case of a composite electric conductor on the outside of the ceramic outer conductor. The second lateral surface to be soldered may then be on the outside of the metallic inner conductor, provided a matching recess is formed in the ceramic inner conductor. Most simply, both lateral surfaces to be soldered should be provided on the ceramic conductors, it being especially preferred to give the ceramic inner conductor, the ceramic outer conductor and, preferably, also the insulator separating the two a common lateral surface in frustum shape, which latter can be produced at low cost by a common grinding operation.

That embodiment of the invention provides the additional advantage that due to the conical surface of the insulator the two pairs of contact surfaces show a relatively large spacing between the ceramic inner conductor and the ceramic outer conductor, which spacing will be the larger the smaller the cone angle of the cone is selected. Any solder that may be squeezed out through the joint clearance during the soldering operation, will therefore not produce an undesirable electric shunt between the two pairs of contact surfaces.

The embodiment of the invention where one of the lateral surfaces to be soldered is provided on the outside of the ceramic outer conductor and the other ceramic lateral surface to be soldered is provided on the outside of the metallic inner conductor, promises higher mechanical stability of the joint, but is connected with a somewhat higher risk of an electric shunt forming as a result of squeezed-out solder, which risk can however preferably be limited by giving the insulator, which separates the ceramic inner conductor from the ceramic outer conductor, a blunt end face.

In the same embodiment of the invention, the frustum-shaped inner surface of the ceramic inner conductor preferably transitions to a short cylindrical blind bore in which an access of active solder, if any, can be accommodated.

The metallic inner conductor preferably is provided with a neck in the neighborhood of the joint to the ceramic inner conductor. This reduces the bending strength of the metallic inner conductor, thereby facilitating assembly of the composite conductor because the ceramic inner conductor and the metallic inner conductor can be centered more easily one on the other without any risk of the ceramic inner conductor breaking.

Due to the fact that they are soldered to the ceramic inner conductor and the ceramic outer conductor the metallic inner conductor and the metallic outer conductor are kept at a spacing one from the other at the joint. Insulation between the metallic inner conductor and the metallic outer conductor is preferably achieved by air and, if necessary, in some areas also by one or more annular insulators provided between the metallic outer conductor and the metallic inner conductor. Such an annular insulator not only provides the advantage to guarantee the required electric separation between the metallic inner conductor and the metallic outer conductor but also allows the two metallic conductors to be mechanically connected to each other by friction, by deforming the outer conductor in the area of the annular insulator, for example by crimping.

The composite conductor according to the invention is suited for leading-in or leading-out purposes, for example for running a metallic or ceramic conductor tightly through a wall into a tight housing to be used at higher temperatures. Such a conductor may, for example, be soldered to a corresponding seating surface made from insulating ceramics, via a conical contact surface. It is likewise suited for ionization electrodes and for glow igniters with a ceramic heater element of the kind used in the burners of heating systems and in independent vehicle heaters. The invention is further suited for sensors with ceramic components for use at high temperatures that are limited by the beginning of the melting interval of the solder. Composite electric conductors according to the invention can be used without any problem at temperatures of up to 700° Celsius.

The invention is particularly well suited for glow plugs for diesel engines. Glow plugs comprise a metallic housing with an external thread for being screwed into a receiving opening in the diesel engine. A glow pencil seated in the housing projects beyond the metallic housing and into the combustion chamber of the diesel engine. At the rear, a connection line is run out of the housing in insulated relationship to the housing. The role of the second terminal (ground terminal) usually is taken over by the housing as such.

When a coaxial conductor composed according to the invention is used for such a glow pencil, then the housing of the glow pencil serves as the metallic outer conductor or as component of the metallic outer conductor of the composite electric conductor according to the invention, or forms a continuation of the metallic outer conductor. Preferably, the housing is supplemented by a metallic sleeve fitted in the forward end of the housing that faces the combustion chamber of the diesel engine. The metallic sleeve should be part of the composite electric conductor according to the invention. Conveniently, the soldered connections of the composite conductor according to the invention should be made before the composite electric conductor is fitted in the housing of the glow plug. This facilitates production of the glow plug. Once the soldered connections have been made, the metallic sleeve is inserted into the housing of the glow plug from the forward end and is fixed in that position, most simply by pressing it home. The sleeve will then project a certain length beyond the forward end of the housing of the glow plug, while the ceramic inner conductor and the ceramic outer conductor will project beyond the forward end of the metallic sleeve and will be connected with each other at their tips by a ceramic heating element formed, for example, in accordance with DE 103 53 972 A1.

BRIEF DESCRIPTION OF THE DRAWINGS

Further features and advantages of the invention will become apparent from the description of certain embodiments of the invention given hereafter.

FIG. 1 shows a longitudinal section through a portion of the composite conductor according to the invention;

FIG. 2 shows a portion of the conductor illustrated in FIG. 1, in an enlarged scale;

FIG. 3 shows a longitudinal section through a second embodiment of a portion of the composite conductor according to the invention;

DETAILED DESCRIPTION

Figure 4:
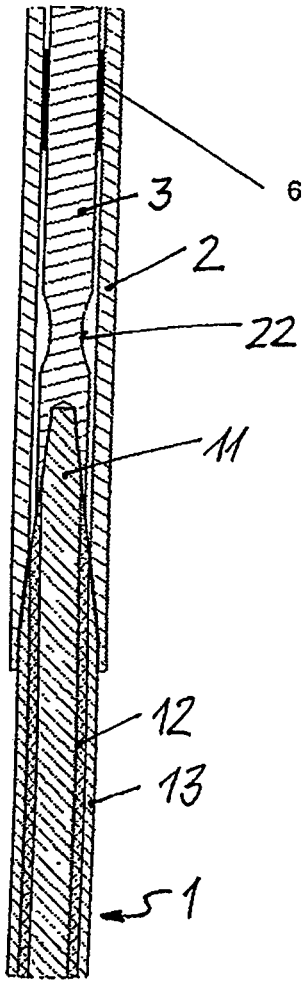
FIG. 4 shows a longitudinal section through a third embodiment of a portion of the composite conductor according to the invention.

Identical or corresponding parts in the different examples are indicated by corresponding reference numerals.

FIGS. 1 and 2 show a composite conductor with a ceramic coaxial conductor 1, which latter consists of a ceramic inner conductor 11, a ceramic outer conductor 13 and a ceramic insulator 12 arranged between the two. The ceramic outer conductor 13 is connected to a coaxial metallic outer conductor 2 serving as an electric supply line. The ceramic inner conductor 11 is connected to a coaxial inner conductor 3 serving as a supply line.

The ceramic coaxial conductor 1 tapers conically towards its end. This has the effect to provide the ceramic inner conductor 11 with a frustum-shaped lateral surface 10, the ceramic outer conductor 13 with a frustum-shaped lateral surface 14 and the insulator 12 with a frustum-shaped lateral surface 16, which surfaces transition seamlessly one to the other. The metallic inner conductor 3 comprises a matching recess 7 with a frustum-shaped internal surface 8, which is followed by a short cylindrical blind bore 9. The metallic outer conductor 2 has a matching frustum-shaped inner surface 15, which is followed by a continuous cylindrical bore 17. Half the included angle between the frustum-shaped surfaces, i.e. the angle between the lateral surface of the cone and the longitudinal axis 37, is equal to approximately 10°.

Prior to fitting the metallic outer conductor 2 on the ceramic outer conductor 13 and the metallic inner conductor 3 on the metallic inner conductor 11, an active solder foil wound up to a conical shape is introduced into each of the conical recess 7 in the metallic inner conductor 3 and the conical recess in the metallic outer conductor 2. The foil is then uncoiled and clamped by fitting the ceramic coaxial conductor 1. Once the active solder has been heated up to its working temperature, it will distribute itself in the joint clearances in the form of a uniform thin foil so as to connect the metallic conductors 2 and 3 to the ceramic conductors 12 and 11, respectively, through a large but thin solder layer 4 and 5, respectively, between which a spacing will be maintained on the insulator 12 through the frustum-shaped lateral surface 16, which spacing will be big enough to prevent any undesirable electric shunt from forming between the two solder layers 4 and 5. The thickness of the solder layers 4 and 5 has been exaggerated in the drawings.

That arrangement is self-centering, sturdy and compact.

The embodiment illustrated in FIG. 3 differs from the first embodiment in that the ceramic inner conductor 11, instead of being provided with a frustum-shaped lateral surface, has a frustum-shaped inner surface 18 that transitions to a short cylindrical blind bore 19. Correspondingly, the metallic inner conductor 3 has a matching frustum-shaped lateral surface 20. The metallic outer conductor 2 is thinner than in the first embodiment and has the same wall thickness all over its length so that its conical portion is conical on both its outside and its inside. The insulator 12 is provided with a blunt end face 21 that separates the two solder layers 4 and 5 from each other.

This embodiment provides higher mechanical stability than the one illustrated in FIGS. 1 and 2, at the cost of a smaller spacing between the two solder layers 4 and 5.

Figure 5:
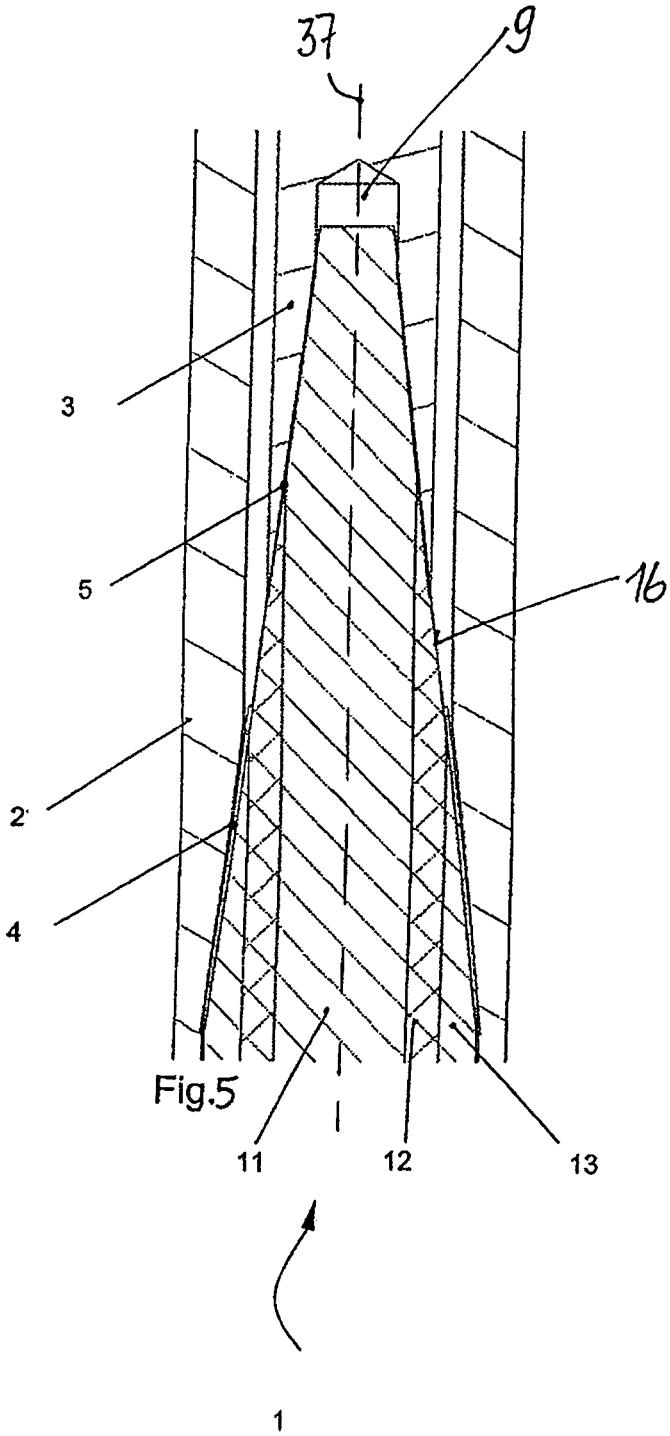
FIG. 5 shows a detail of the example illustrated in FIG. 4, at an enlarged scale.

The embodiment illustrated in FIGS. 4 and 5 differs from that shown in FIGS. 1 and 2 in that the metallic outer conductor 2 is extended beyond the end of the ceramic inner conductor 11 so that it coaxially encloses the metallic inner conductor 3 as well. In order to guarantee an electric separation between the metallic outer conductor 2 and the metallic inner conductor 3 in view of that extension, an annular insulator 6 is provided between the two solder joints, at some distance from the latter. Between that insulator and the tip of the ceramic inner conductor 11, a neck 22 is provided in the metallic inner conductor 3 which reduces the bending strength of the metallic inner conductor 3 and facilitates the operation of centering the metallic inner conductor 3 and the ceramic inner conductor 11 one on the other.

The metallic inner conductor 3 and its connection area are shielded from the outside by the coaxial metallic outer conductor 2 in that embodiment.

Figure 6:
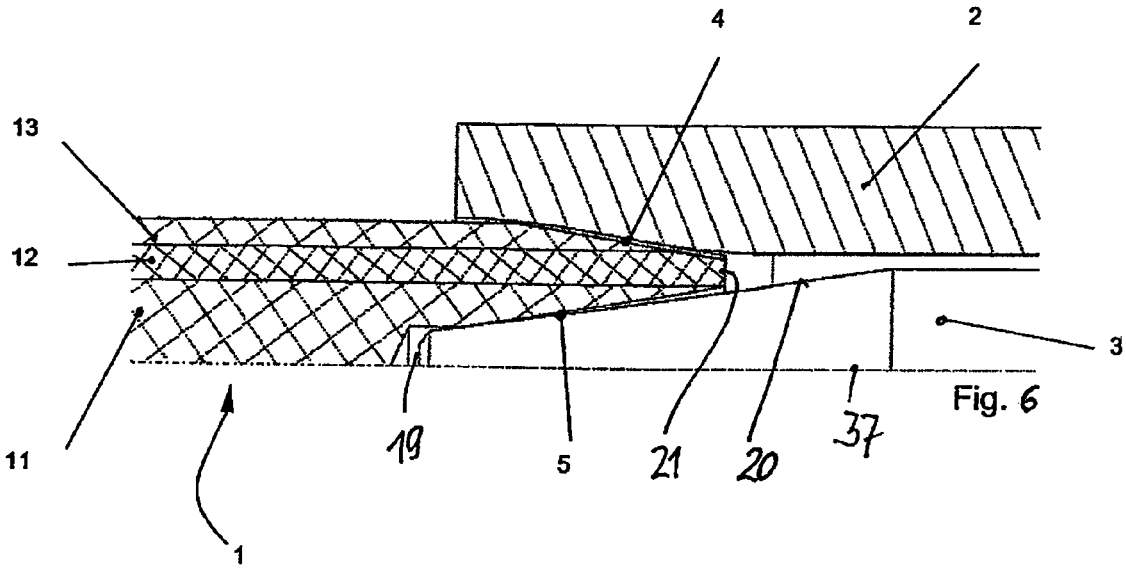
FIG. 6 shows a longitudinal section through a fourth embodiment of a conductor according to the invention.

The fourth embodiment illustrated in FIG. 6 differs from the second embodiment illustrated in FIG. 3 in that the metallic outer conductor 2 extends from the connection area in the opposite direction, thereby coaxially enclosing the metallic inner conductor 3. The metallic outer conductor 2 does not have a continuous wall thickness; instead, the latter is reduced by the conical recess provided in the connection area, that resulted in the frustum-shaped inner surface 15.

Figure 7:
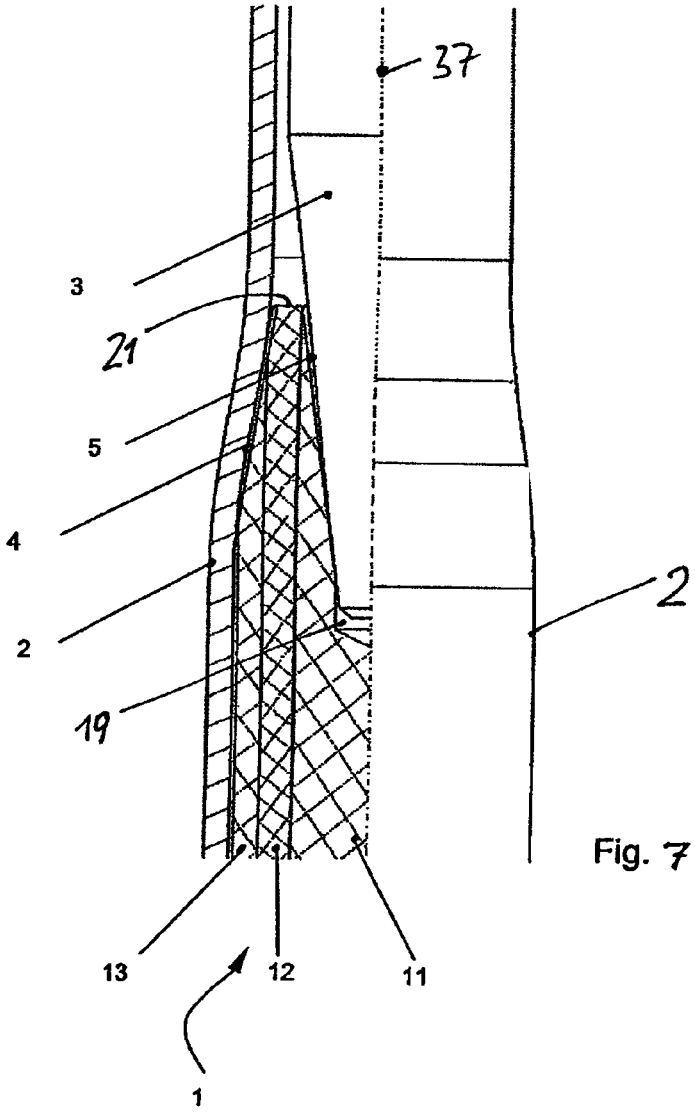
FIG. 7 shows a longitudinal section through a fifth embodiment of a conductor according to the invention.

The fifth embodiment of a composite conductor illustrated in FIG. 7 differs from the second embodiment illustrated in FIG. 3 in that the metallic outer conductor 2 has a continuous wall thickness and is extended beyond the connection area so that it coaxially encloses not only the ceramic coaxial conductor 1, but the metallic inner conductor 3 as well.

Figure 8:
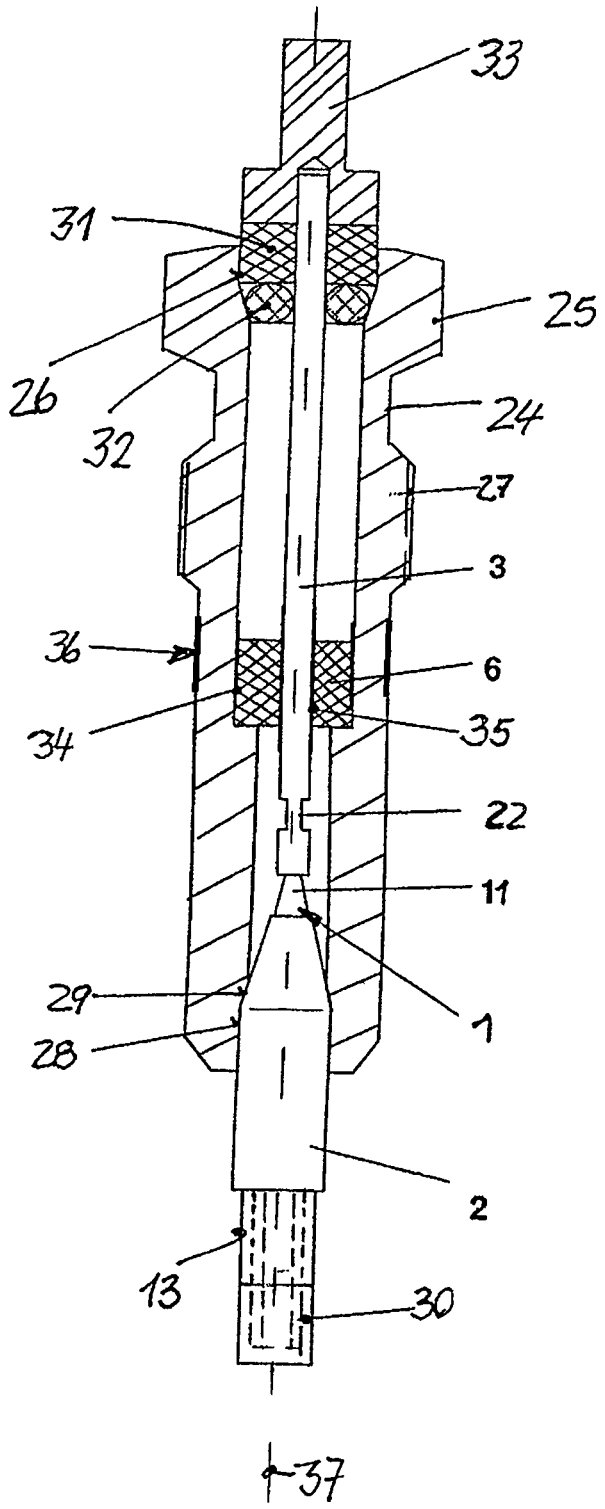
FIG. 8 shows a longitudinal section through a first embodiment of a glow plug according to the invention.

FIG. 8 shows a glow plug comprising a composite conductor according to the invention. The glow plug has a metallic housing 24 and a head portion 25 provided with a conically tapering opening. A thicker housing portion with an external thread 27 is provided at a distance from the head portion 25. The forward end of the housing 24, remote from the head portion 25, is provided with a cylindrical opening 28, followed by a conically tapering portion 29. A metallic sleeve 2, which transitions to a conical portion coaxially enclosing a ceramic coaxial conductor 1, is introduced into the cylindrical opening 28 from the front and is pressed home into the conical portion 29. The ceramic coaxial conductor 1 projects beyond the forward end of the sleeve 2 and is closed off by a heating element 30 connecting the ceramic outer conductor 13 to the ceramic inner conductor 11, which latter is indicated by broken lines only in FIG. 8.

Inside the conical portion of the sleeve 2, there is provided a soldered joint between the ceramic outer conductor 13 and the metallic sleeve 2, which constitutes a coaxial outer conductor of the composite conductor according to the invention. When the sleeve 2 is pressed into the housing 24, the housing 24 likewise acts as a coaxial metallic outer conductor of a composite conductor according to the invention. A bar-shaped metallic inner conductor 3, extending coaxially inside the housing 24, is supported and guided by an annular insulator 6 approximately in the middle of the housing 24 and by a further annular insulator 31 in the head portion 25. A closure element 32 arranged before the annular insulator 31, in the conical portion of the opening 26 provided in the housing in that area, coacts with the annular insulator 31 to tightly close the rear end of the housing. Mounted on the rear end of the metallic inner conductor 3 is a connection terminal 33 which is electrically insulated from the housing 24 by the annular insulator 31.

The conically tapering ceramic inner conductor 11, projecting from the sleeve 2 into the interior of the housing, is fitted in the forward end of the metallic inner conductor 3 and is soldered to the metallic inner conductor 3 in the manner suggested by the invention. Between the ceramic inner conductor 11 and the annular insulator 6, there is provided a neck 22 in the metallic inner conductor 3 the function of which has already been described above.

At the level of the annular insulator 6, the metallic inner conductor 3 and the inner wall of the housing 24 are roughened or provided with a knurled or grooved surface 34 or 35, respectively, which is intended to enhance the firm seating of the annular insulator 6 in the housing 24. For locating the annular insulator 6, the housing 24 may be additionally deformed in the area 36 of the housing 24, for example compressed to a certain degree by crimping. This guarantees that the metallic inner conductor 3 will not be pulled off the housing 34 when a connector is pulled off the connection terminal 33.

In principle, the connection between the ceramic coaxial conductor 1 and the two metallic conductors 2 and 3 is realized in the way illustrated in FIG. 2.

Figure 9:
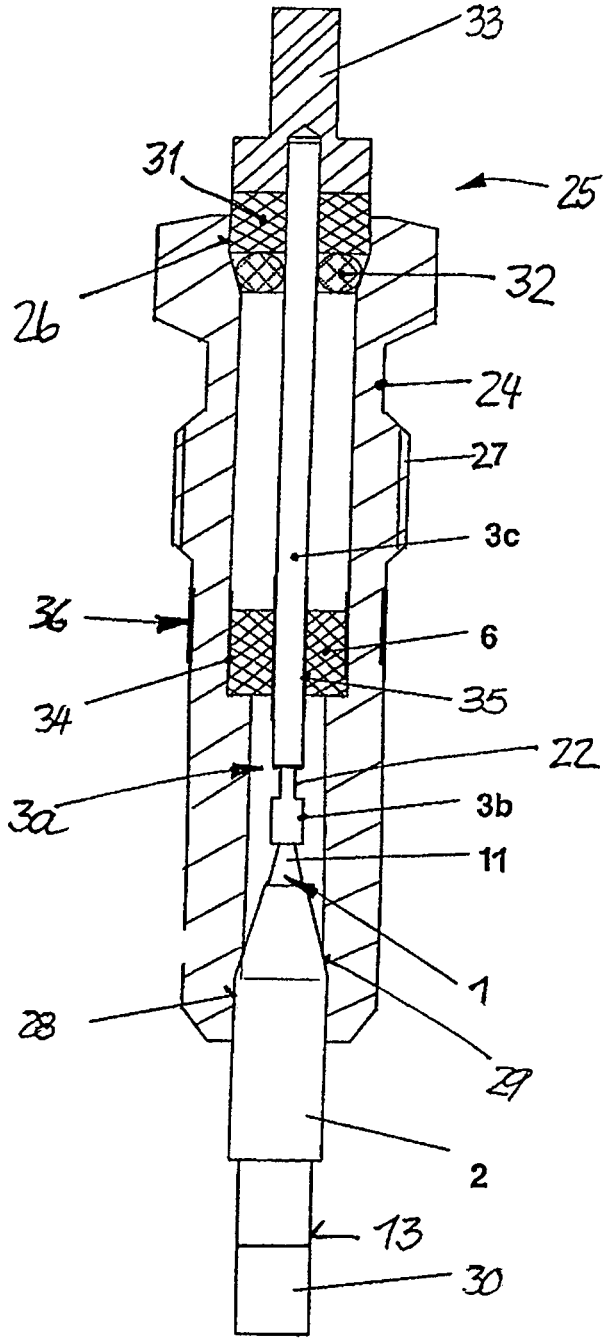
FIG. 9 shows a longitudinal section through a second embodiment of a glow plug according to the invention.

The glow plug illustrated in FIG. 9 differs from the one shown in FIG. 8 in that a separation 3*a* is provided in the metallic inner conductor 3 through which the latter is subdivided into two portions 3*b* and 3*c*. The separation 3*a* is arranged between the ceramic inner conductor 11 and the annular insulator 6. This allows an arrangement consisting of the ceramic coaxial conductor 1, the metallic sleeve 2 as an outer conductor and the portion 3*b* of the metallic inner conductor to be pre-fabricated as a standard component for different embodiments of glow plugs, and to be combined later with different housings 24 and different portions 3*c* of the metallic outer conductor 3. The two portions 3*a* and 3*b* can be soldered or welded to each other after assembly of the composite conductor according to the invention.

Figure 10:
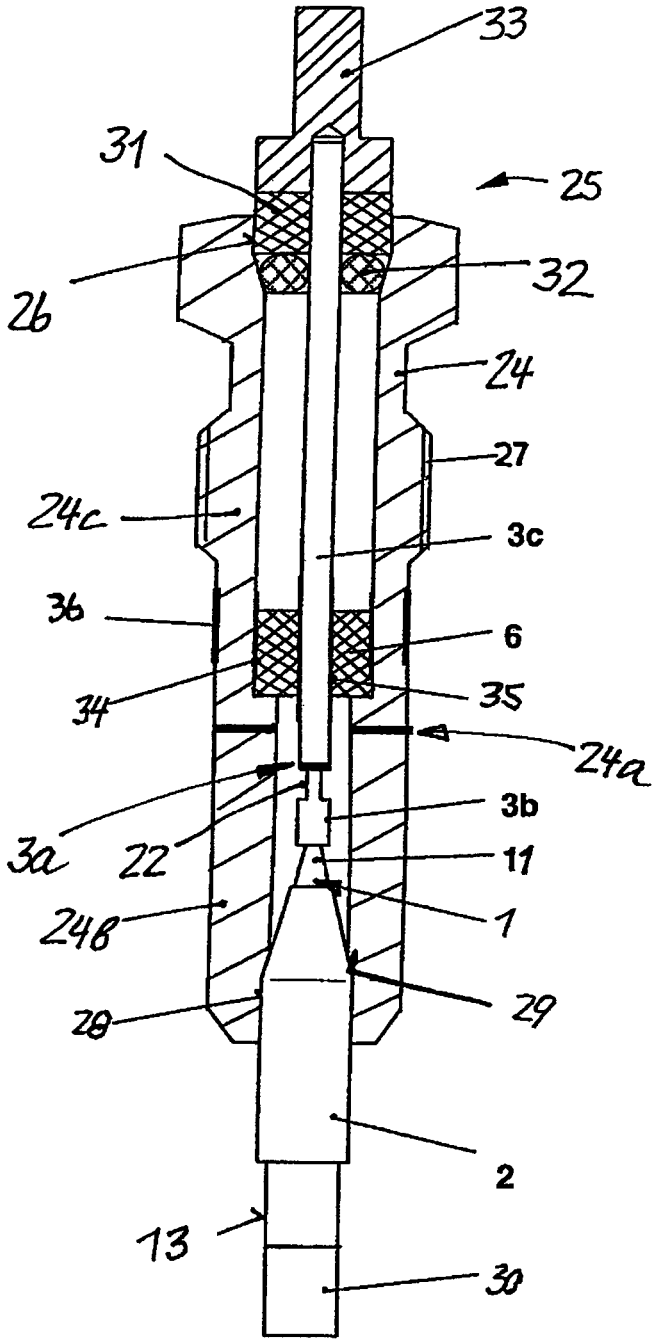
FIG. 10 shows a longitudinal section through a third embodiment of a glow plug according to the invention.
Figure 11:
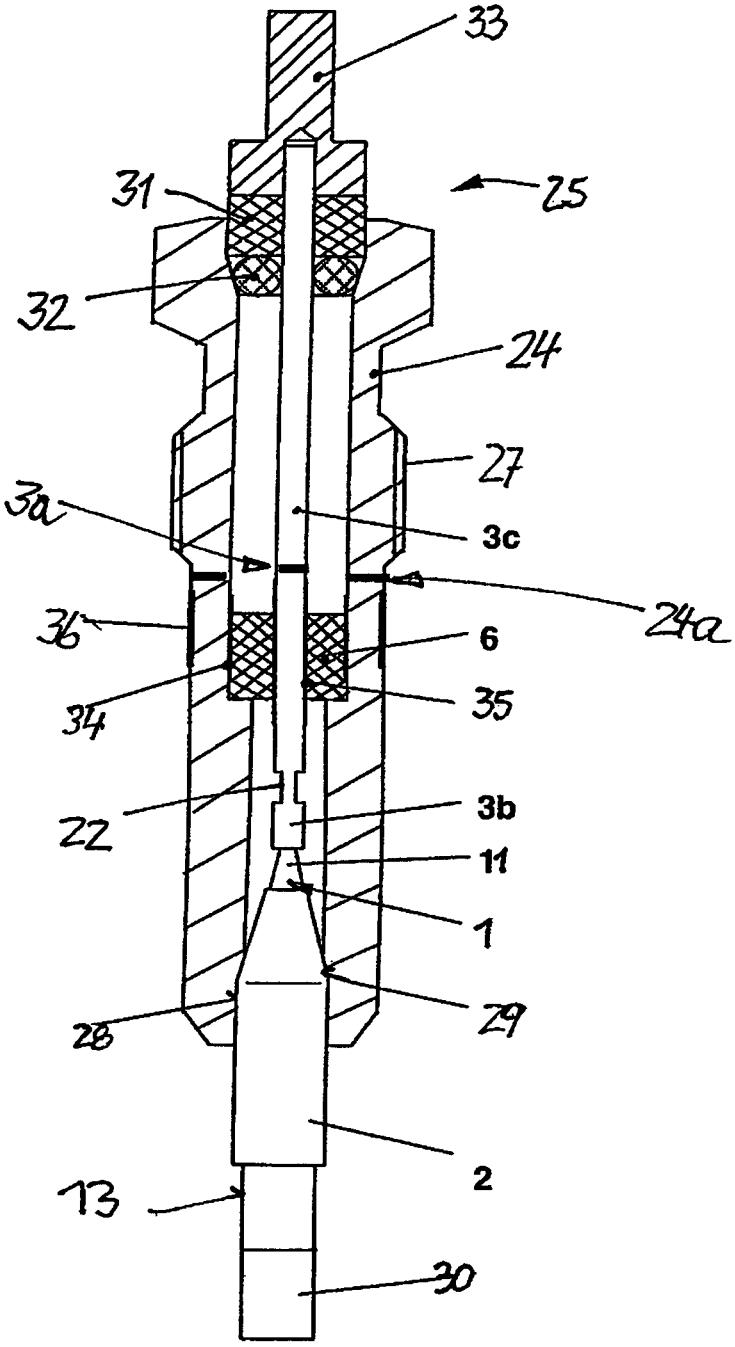
FIG. 11 shows a longitudinal section through a fourth embodiment of a glow plug according to the invention.

Still further rationalization is rendered possible by the embodiment illustrated in FIG. 10 which differs from the embodiment illustrated in FIG. 9 in that the housing 24 is also provided with a transverse separation 24*a* by which it is subdivided into a forward portion 24*b* and a rear portion 24*c*. This embodiment provides the advantage that it is now possible to pre-fabricate in standard dimensions not only the composite conductor, consisting of the ceramic coaxial conductor 1, the sleeve 2 as outer conductor and the portion 3*b* of the metallic inner conductor, but also the forward portion 24*c* of the housing, in which the composite conductor, having been pre-fabricated in standard dimensions, has already been mounted. Such a standardized forward portion of the glow plug can be efficiently combined with differently configured rear glow plug portions. The same applies to the embodiment illustrated in FIG. 11 which differs from the embodiment illustrated in FIG. 10 in that the separations 3*a* and 24*a* have been placed in the area between the annular insulator 6 and the external thread 27 which means that the annular insulator 6 has been additionally included into the scope of standardized pre-fabrication.

For producing such a glow plug, one initially solders, in the manner proposed by the invention, the ceramic coaxial conductor 1 to the sleeve 2 as metallic outer conductor and the portion 3*b* of the metallic inner conductor and then assembles the unit to the forward portion 24*b* of the housing. Thereafter, the forward portion 24*b* of the housing is deformed in the area 36, and the annular insulator 6 is pressed against the portion 3*b* of the metallic inner conductor. The next step consists in attaching the rear portion 3*c* to the forward portion 3*b* of the metallic inner conductor. Once this has been done, the rear portion 24*c* is attached to the forward portion 24*b* of the housing 24, and finally the closure element 30, the annular insulator 31 and the connection terminal 33 are mounted.

Figure 12:
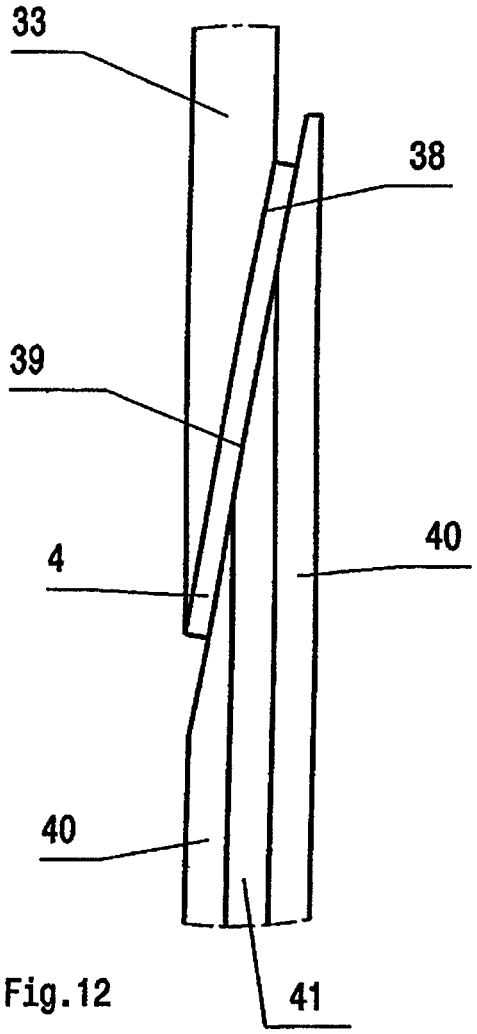
FIG. 12 shows a longitudinal section through a connection between a metallic conductor and an insulating ceramic conductor.

FIG. 12 shows a composite conductor consisting of an elongate ceramic conductor 41, embedded in a ceramic insulator 40 by which it is sort of sheathed, and of an elongate metallic conductor 33 which may be a connection terminal. The metallic conductor 33 is provided with a contact area 39 at its end. The ceramic conductor 41 is provided with a contact area 39 at its end. Both contact areas 38 and 39 extend at an acute angle of 10°, for example, relative to the longitudinal axis of the conductors 33 and 41. The contact area 39 of the ceramic conductor 41 transitions to an inclined surface of the ceramic insulator 40 aligned with it. A hard solder layer 4, covering the whole contact area 38 of the metallic conductor, is provided between the two contact areas 38 and 39. The contact area 38 being larger than the contact area 39 of the ceramic conductor 41, the hard solder layer 4 covers not only the full contact area 39 of the ceramic conductor 41 but also part of the adjoining inclined surface of the insulator 40. The thickness of the hard solder layer 4 has been exaggerated in the drawing.

In order to position the two conductors 33 and 41 properly for the soldering operation, one may for example use two pre-positioned sleeves, arranged at a distance one opposite the other, one of which serves to guide and align the metallic conductor 32 while the other serves to guide and align the ceramic conductor 41 with its sheath 40. The two conductors can then be advanced toward each other through the sleeves until their contact areas 38 and 39 are pressed against each other, with a hard solder foil 24 clamped between them. The spacing at which the two sleeves are arranged is selected so that the zone of the contact areas 38 and 39 remains exposed. Upon completion of the soldering operation, the composite conductor can be withdrawn from the sleeves through the larger one of the two sleeves.

Figure 13:
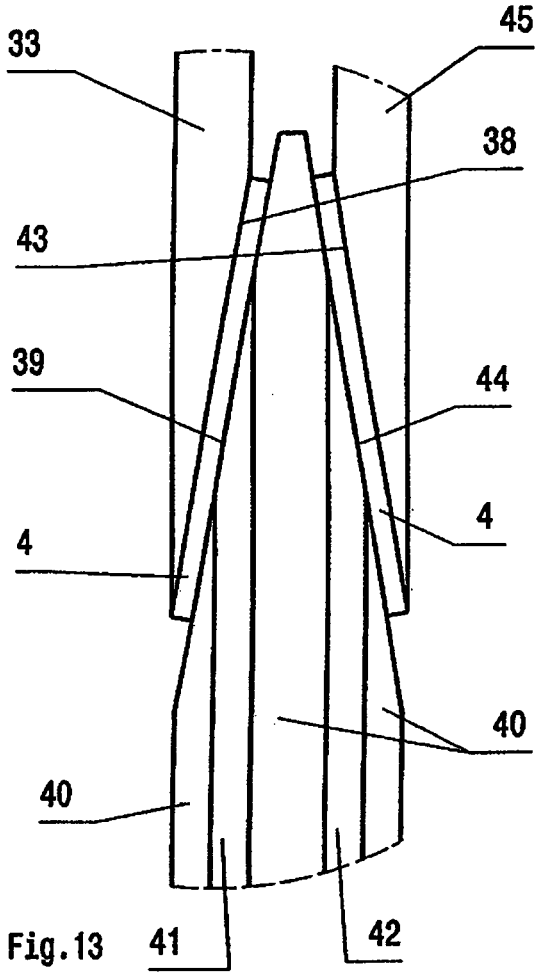
FIG. 13 shows a longitudinal section through a sixth embodiment of a conductor according to the invention, suited for a glow plug with ceramic glow pencil.

The embodiment illustrated in FIG. 13 shows two mutually parallel ceramic conductors 41 and 42, embedded in an insulator 40 by which they are sheathed. Both ceramic conductors 41 and 42 are provided with a contact area 39 or 44, respectively, which extend obliquely to their respective elongate axis and transition to respective inclined surfaces of the insulator 40 aligned with them. The contact areas 39 and 44 intersect the longitudinal axis of the ceramic conductors 41 and 42 at an acute angle of 10°, for example, and form together a wedge-shaped arrangement. The contact areas 39 and 45 are each hard-soldered to a metallic conductor 33 and 44, respectively, similarly provided with obliquely extending contact areas 43. The thickness of the joining hard solder layer 4 has been exaggerated in the drawing and extends over the contact areas and part of the adjoining inclined surfaces of the insulator 40.

For positioning the conductor for the hard soldering operation, the two metallic conductors 33 and 45 may be retained in a gauge, for example a rail of U-shaped cross-section, and the wedge-shaped tapering end of the arrangement consisting of the two ceramic conductors 41 and 42 and their insulator 40 may be introduced into the wedge-shaped space between the two metallic conductors 33 and 45 until the two contact areas are pressed against each other, with a solder foil 4 positioned between them. Following the hard soldering operation, which may be effected by induction, the composite conductor may then be removed from the gauge.

The composite conductor illustrated in FIG. 13 is suited for a glow plug with a ceramic heating resistor and non-coaxial arrangement of the conductors.

Figure 14:
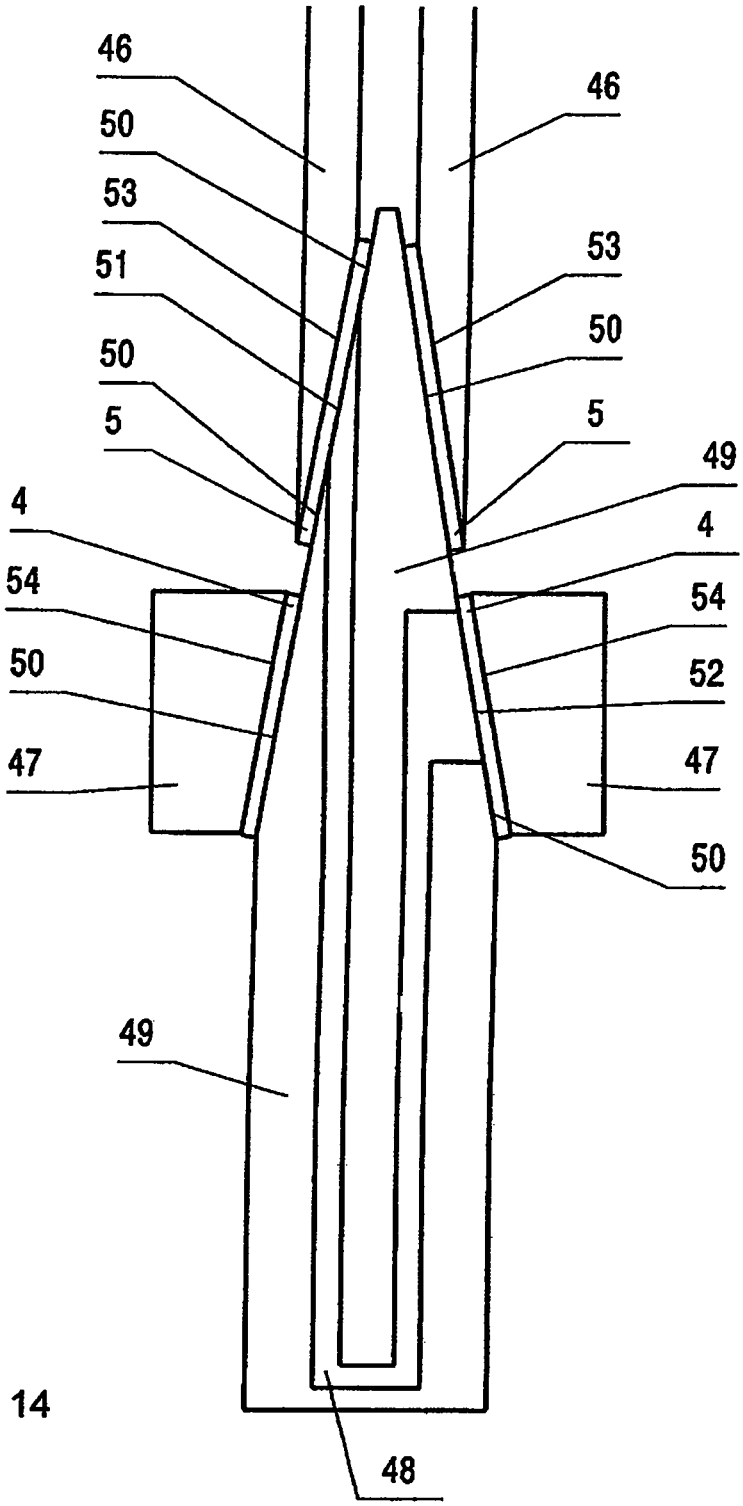
FIG. 14 shows a longitudinal section through a seventh embodiment of a conductor according to the invention, suited for a glow plug with ceramic glow pencil.

The embodiment illustrated in FIG. 14 shows a ceramic glow pencil for a glow plug, consisting of a U-shaped ceramic electric heating conductor 48 and a ceramic insulator 49 in which the heating conductor 48 is embedded. The glow pencil is conical at its end opposite the combustion chamber. The one leg of the ceramic heating conductor 48 leads straight to the conical surface 50 of the glow pencil where it forms a first contact area 51. The other leg of the U-shaped ceramic heating conductor 48 has a bent-off end and ends at a point of the conical surface 50 which is spaced from the tip of the conical surface 50 a greater distance than the first contact area 51, forming a second contact area 52. The second contact area 52 is soldered to a metallic sleeve 47 which is part of, or connected with, the metallic housing of a glow plug and is connected to ground potential in operation. The first contact area 51 is connected to an elongate metallic conductor 46 of tubular configuration, which expands conically on its one end at a cone angle identical to the cone angle of the glow pencil. In operation of the glow plug, the metallic conductor 46 is supplied with the positive potential of the on-board system of the diesel engine vehicle.

For connecting the conductors with each other, a wound-up piece of hard solder foil 4 is introduced into the conical opening of the metallic sleeve 47, where it will adapt itself to the conical contact surface 54 of the sleeve. Another wound-up piece of hard solder foil 5 is introduced into the tubular metallic conductor 46, where it adapts itself to its conical contact surface 53. By fitting the sleeve 47 and the metallic conductor 46 on the cone surface 50 of the ceramic glow pencil, the solder foils 4 and 5 are clamped between the cone surfaces pressing one against the other so that any access of oxygen is largely avoided during the hard soldering operation. Due to the pressure, which is maintained during the soldering operation, a tight uniformly thin hard solder layer is produced that joins the ceramic and metallic contact areas one with the other.

Ceramic materials suitable for use in glow plugs are aluminum oxide, zirconium dioxide, silicon carbide and silicon nitride. Suited as metallic materials are, for example, steel grades 15 and 11 S Mn Pb 30 as well as Inconel.

The invention allows glow plugs with ceramic glow pencil, that distinguish themselves by a long service life, to be produced at low cost and in a way suited for large-series production. A two-piece design of the metallic inner conductor allows the ceramic glow pencils to be tested immediately after they have been soldered to their metallic supply lines. The ceramic glow pencils can be produced on stock, as standard components. Final assembly can then be carried out at a different place and at a different time. The allocation of glow pencils to customer orders that require different rear portions is only effected at the time of final assembly. The two-part design of the metallic inner conductor 3 and the housing 24 allows different materials to be matched in those parts.

LIST OF REFERENCE NUMERALS

1 ceramic coaxial conductor
2 metallic outer conductor
2*a* conical portion
3 metallic inner conductor
3*a* separation
3*b*, 3*c* portions of 3
4 solder layer
5 solder layer
6 annular insulator
7 recess
8 frustum-shaped inner surface of 3
9 cylindrical blind bore in 3
10 frustum-shaped lateral surface of 11
11 inner conductor of 1
12 insulator of 1
13 outer conductor of 1
14 frustum-shaped lateral surface of 13
15 frustum-shaped inner surface of 2
16 frustum-shaped lateral surface of 12
17 cylindrical bore
18 frustum-shaped inner surface of 11
19 cylindrical blind bore
20 frustum-shaped lateral surface of 3
21 blunt end face
22 neck
23 -
24 housing
24*a* separation
24*b*, 24*c* portions of 24
25 head portion
26 opening
27 external thread
28 cylindrical opening
29 conical portion
30 heating element
31 insulator
32 closure element
33 connection terminal
34 knurled, grooved surface
35 knurled, grooved surface
36 area
37 longitudinal direction or longitudinal axis, respectively
38 contact area
39 contact area
40 ceramic insulator
41 ceramic conductor
42 ceramic conductor
43 contact area
44 contact area
45 metallic conductor
46 metallic conductor
47 metallic sleeve
48 ceramic heating conductor
49 ceramic insulator
50 cone surface
51 contact area
52 contact area
53 contact area
54 contact area

What is claimed is:

1. Composite electric conductor comprising:

an elongate ceramic inner conductor;

an elongate ceramic outer conductor enclosing the ceramic inner conductor, and an insulator arranged between the ceramic inner conductor and the ceramic outer conductor;

an elongate metallic inner conductor which is connected to the ceramic inner conductor in an electrically conductive manner; and an elongate metallic outer conductor which is connected to the ceramic outer conductor in an electrically conductive manner, wherein both of the ceramic conductors and their corresponding metallic conductors are fitted one in the other and make contact primarily via a lateral surface extending obliquely to their longitudinal direction and via an oppositely arranged inner surface, said surfaces being hard-soldered one to the other.

2. Conductor according to claim 1, wherein the metallic outer conductor encloses the metallic inner conductor.

3. Conductor according to claim 1, wherein the inner conductors and the outer conductors are arranged coaxially one relative to the other.

4. Conductor according to claim 1, wherein the contact-making lateral surfaces are frustum-shaped surfaces.

5. Conductor according to claim 1, wherein the ceramic inner conductor has a frustum-shaped inner surface which transitions to a cylindrical blind hole.

6. Conductor according to claim 1, wherein the insulator, separating the ceramic inner conductor from the ceramic outer conductor, has a blunt end face.

7. Conductor according to claim 1, wherein the metallic inner conductor has a neck in the neighborhood of the point of connection to the ceramic inner conductor.

8. Conductor according to claim 1, wherein an annular insulator is only in some places in an annular gap between the metallic outer conductor and the metallic inner conductor.

9. Conductor according to claim 1, wherein it is designed as a glow plug for a diesel engine.

10. Conductor according to claim 9 comprising a metallic housing, which is the metallic outer conductor or part of the metallic outer conductor.

11. Conductor according to claim 10, wherein a metallic sleeve, being part of the outer conductor is fitted in a forward end of the metallic housing which faces in use the combustion chamber of a diesel engine.

12. Glow plug according to claim 11, wherein the metallic sleeve is pressed into the metallic housing from the forward end.

13. Conductor according to claim 11, wherein the sleeve projects beyond the forward end of the metallic housing.

14. Conductor according to claim 11, wherein the ceramic inner conductor and the ceramic outer conductor project beyond the forward end of the metallic sleeve and are connected one to the other at their tips by a ceramic heating element.

15. Conductor according to claim 11, wherein the metallic housing is subdivided in trans-verse direction.

16. Conductor according to claim 15, wherein the metallic housing is subdivided in the neighborhood of an annular insulator.

17. Conductor according to claim 15, wherein the metallic inner conductor is subdivided in transverse direction.

18. Conductor according to claim 17, wherein the areas where the metallic inner conductor and the metallic housing are subdivided in transverse direction are positioned close to each other.

19. Composite electric conductor comprising:

an elongate ceramic inner conductor;

an elongate ceramic outer conductor enclosing the ceramic inner conductor, and an insulator arranged between the ceramic inner conductor and the ceramic outer conductor;

an elongate metallic inner conductor which is connected to the ceramic inner conductor in an electrically conductive manner; and an elongate metallic outer conductor which is connected to the ceramic outer conductor in an electrically conductive manner, wherein both of the ceramic conductors and their corresponding metallic conductors are fitted one in the other and make contact primarily via a common lateral surface extending obliquely to their longitudinal direction and via an oppositely arranged inner surface, said surfaces being hard-soldered one to the other.

* * * * *